US008943622B2

(12) United States Patent
Saint et al.

(10) Patent No.: US 8,943,622 B2
(45) Date of Patent: Feb. 3, 2015

(54) INFANT PLAYPEN APPARATUS PROVIDED WITH UTILITY ACCESSORIES

(71) Applicants: Nathaneal Saint, Morgantown, PA (US); Jonathan K. Mountz, Geigertown, PA (US); Andrew J. Winterhalter, West Lawn, PA (US); Jonathan M. Pacella, Coatesville, PA (US); William B. Bellows, Wyomissing, PA (US)

(72) Inventors: Nathaneal Saint, Morgantown, PA (US); Jonathan K. Mountz, Geigertown, PA (US); Andrew J. Winterhalter, West Lawn, PA (US); Jonathan M. Pacella, Coatesville, PA (US); William B. Bellows, Wyomissing, PA (US)

(73) Assignee: Wonderland Nurserygoods Company Limited, Hong Kong (HK)

( * ) Notice: Subject to any disclaimer, the term of this patent is extended or adjusted under 35 U.S.C. 154(b) by 0 days.

(21) Appl. No.: 13/910,184

(22) Filed: Jun. 5, 2013

(65) Prior Publication Data

US 2013/0326808 A1 Dec. 12, 2013

Related U.S. Application Data

(60) Provisional application No. 61/689,534, filed on Jun. 7, 2012, provisional application No. 61/848,642, filed on Jan. 8, 2013.

(51) Int. Cl.

| | |
|---|---|
| ***A47D 7/00*** | (2006.01) |
| ***A47D 13/06*** | (2006.01) |
| ***A47D 5/00*** | (2006.01) |
| ***A47D 7/04*** | (2006.01) |
| ***A47D 9/00*** | (2006.01) |

(52) U.S. Cl.
CPC *A47D 13/06* (2013.01); *A47D 5/00* (2013.01); *A47D 7/04* (2013.01); *A47D 9/00* (2013.01); *A47D 13/063* (2013.01)
USPC ..... 5/93.1; 5/93.2; 5/99.1

(58) Field of Classification Search
USPC ..... 5/93.1–103
See application file for complete search history.

(56) References Cited

U.S. PATENT DOCUMENTS

| | | | |
|---|---|---|---|
| 150,398 | A | 5/1874 | Clonen et al. |
| 761,514 | A | 5/1904 | Leininger |

(Continued)

FOREIGN PATENT DOCUMENTS

| | | |
|---|---|---|
| CN | 2822391 | 8/2005 |
| CN | 201153769 Y | 10/2008 |

(Continued)

*Primary Examiner* — William Kelleher
*Assistant Examiner* — Richard G Davis
(74) *Attorney, Agent, or Firm* — David I. Roche; Baker & McKenzie LLP

(57) ABSTRACT

An infant playpen apparatus includes a playpen frame having two opposite side frame portions, two rail structures respectively affixed with the two side frame portions, a support platform operable to detachably assemble with the rail structures, and two coupling structures connected with the support platform and operable to respectively assemble with the rail structures. At least one of the coupling structures includes a latch that can lock an assembly of the support platform with the rail structure, and unlock the assembly of the support platform with the rail structure for removing the support assembly from the rail structure. The playpen apparatus can further include a bassinet held with the playpen frame. The support platform can slide along the rail structures between a first position where the support platform substantially uncovers the bassinet, and a second position where the support platform lies above and substantially overlaps with the bassinet.

35 Claims, 14 Drawing Sheets

(56) References Cited

U.S. PATENT DOCUMENTS

| | | | | |
|---|---|---|---|---|
| 839,681 | A | 12/1906 | Voigt, Sr. | |
| 841,700 | A | 1/1907 | Linden | |
| 875,377 | A | 12/1907 | Pilia et al. | |
| 1,154,543 | A | 9/1915 | Passerieux | |
| 1,222,664 | A | 4/1917 | Perna | |
| 1,294,300 | A | 2/1919 | Noel | |
| 2,851,700 | A * | 9/1958 | Denison | 5/93.1 |
| 6,001,047 | A | 12/1999 | Ferrara | |
| 6,526,608 | B1 * | 3/2003 | Hsia | 5/99.1 |
| 6,546,575 | B2 | 4/2003 | DeAngelo | |
| 6,952,849 | B2 * | 10/2005 | Pacella | 5/658 |
| 8,381,333 | B2 | 2/2013 | Friedman | |
| 2004/0187212 | A1 * | 9/2004 | Pacella | 5/503.1 |
| 2006/0130237 | A1 | 6/2006 | Clapper et al. | |
| 2009/0062082 | A1 | 3/2009 | Spencer-Kramer | |
| 2012/0005826 | A1 * | 1/2012 | Bickley | 5/93.1 |
| 2013/0025064 | A1 * | 1/2013 | Holden et al. | 5/655 |

FOREIGN PATENT DOCUMENTS

| | | | |
|---|---|---|---|
| EP | 0549544 | A1 | 12/1992 |
| FR | 564019 | | 12/1923 |
| FR | 2775569 | A1 | 10/1999 |

* cited by examiner

150

INFANT PLAYPEN APPARATUS PROVIDED WITH UTILITY ACCESSORIES

CROSS-REFERENCE TO RELATED APPLICATIONS

This application claims priority to U.S. Provisional Patent Application No. 61/689,534 filed on Jun. 7, 2012, and to U.S. Provisional Patent Application No. 61/848,642 filed on Jan. 8, 2013, the contents of both of which are incorporated herein by reference.

BACKGROUND

1. Field of the Invention

The present invention relates to an infant playpen apparatus provided with utility accessories.

2. Description of the Related Art

An infant playpen may be typically provided with diverse utility accessories that can facilitate care for the child, such as bassinets and changing stations. Because the infant playpen is almost entirely covered with a fabric material, the mechanical connections of the utility accessories with the frame of the infant playpen may be difficult to achieve. For example, a bassinet is usually attached to fixed plastic portions provided on the frame of the playpen. The conventional attachment of the utility accessory may not suit the needs of the individual caregiver, which may depend on various factors such as the position of the playpen in a room, the availability of light, and available access to the playpen.

Therefore, there is a need for an improved design that can provide utility accessories for an infant playpen apparatus that are more convenient and flexible in use, and can address at least the foregoing issues.

SUMMARY

The present application describes an infant playpen apparatus provided with multiple utility accessories that can be conveniently used and adjusted by a caregiver In one embodiment, the present application describes a utility accessory assembly suitable for use with an infant playpen apparatus. The utility accessory assembly includes a rail structure operable to affix with a playpen frame, a support platform operable to assemble with and detach from the rail structure, and a coupling structure operable to slide along the rail structure, wherein the coupling structure includes a latch operable to lock an assembly of the support platform with the rail structure so that the support platform and the coupling fixture are movable in unison along the rail structure, and to unlock the assembly of the support platform with the rail structure for removing the support assembly from the rail structure.

In other embodiments, an infant playpen apparatus is described. The infant playpen apparatus includes a playpen frame having two opposite and parallel side frame portions, two rail structures respectively affixed with the two side frame portions of the playpen frame, a support platform operable to assemble with and detach from the rail structures, two coupling structures connected with the support platform and operable to respectively assemble with the two rail structures for sliding displacement, and a bassinet held with the playpen frame below the support platform. The support platform is operable to slide along the rail structures between a first position where the support platform substantially uncovers the bassinet, and a second position where the support platform lies above and substantially overlaps with the bassinet.

DETAILED DESCRIPTION OF THE EMBODIMENTS

Figure 1:
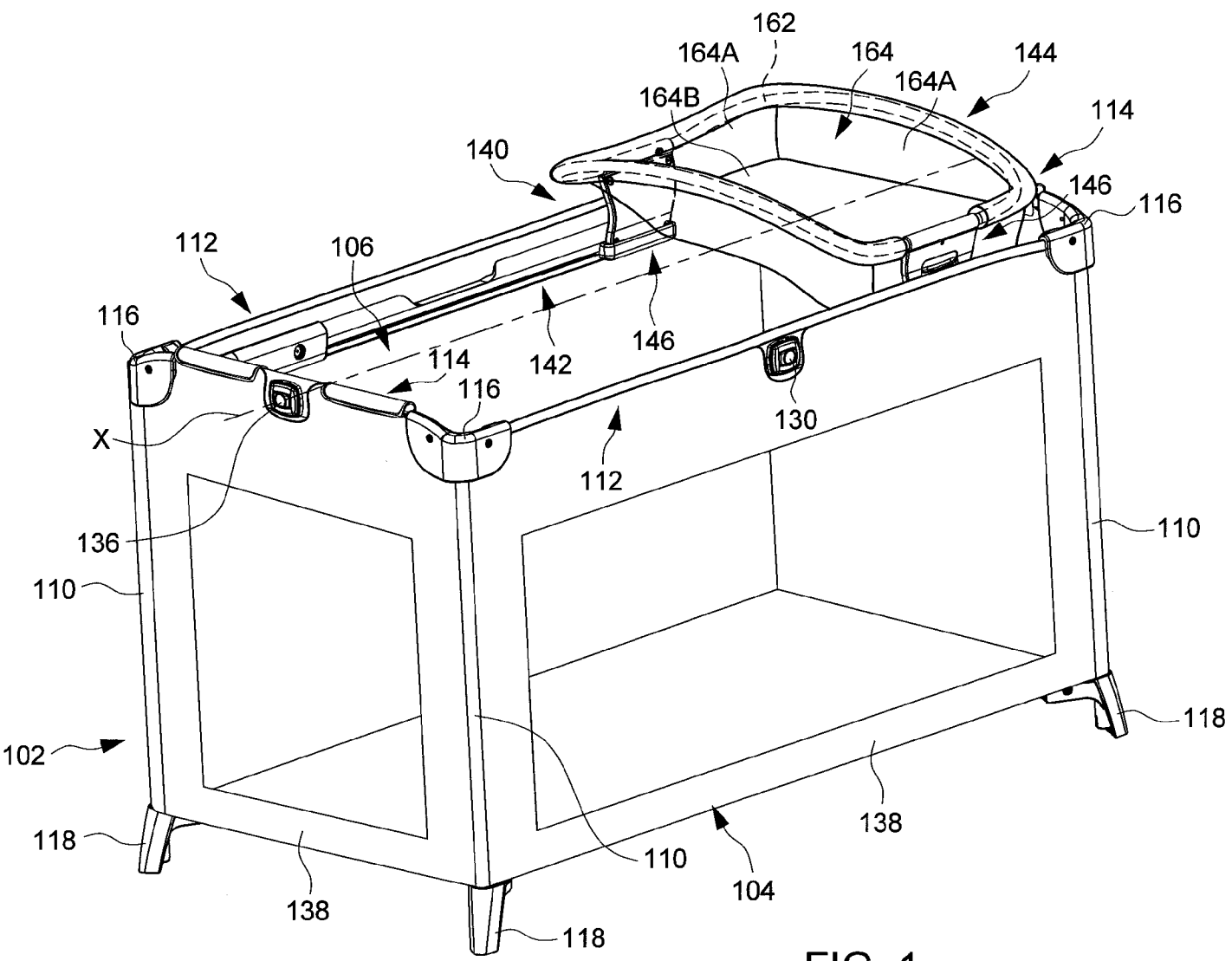
FIG. 1 is a perspective view illustrating one embodiment of an infant playpen apparatus.
Figure 2:
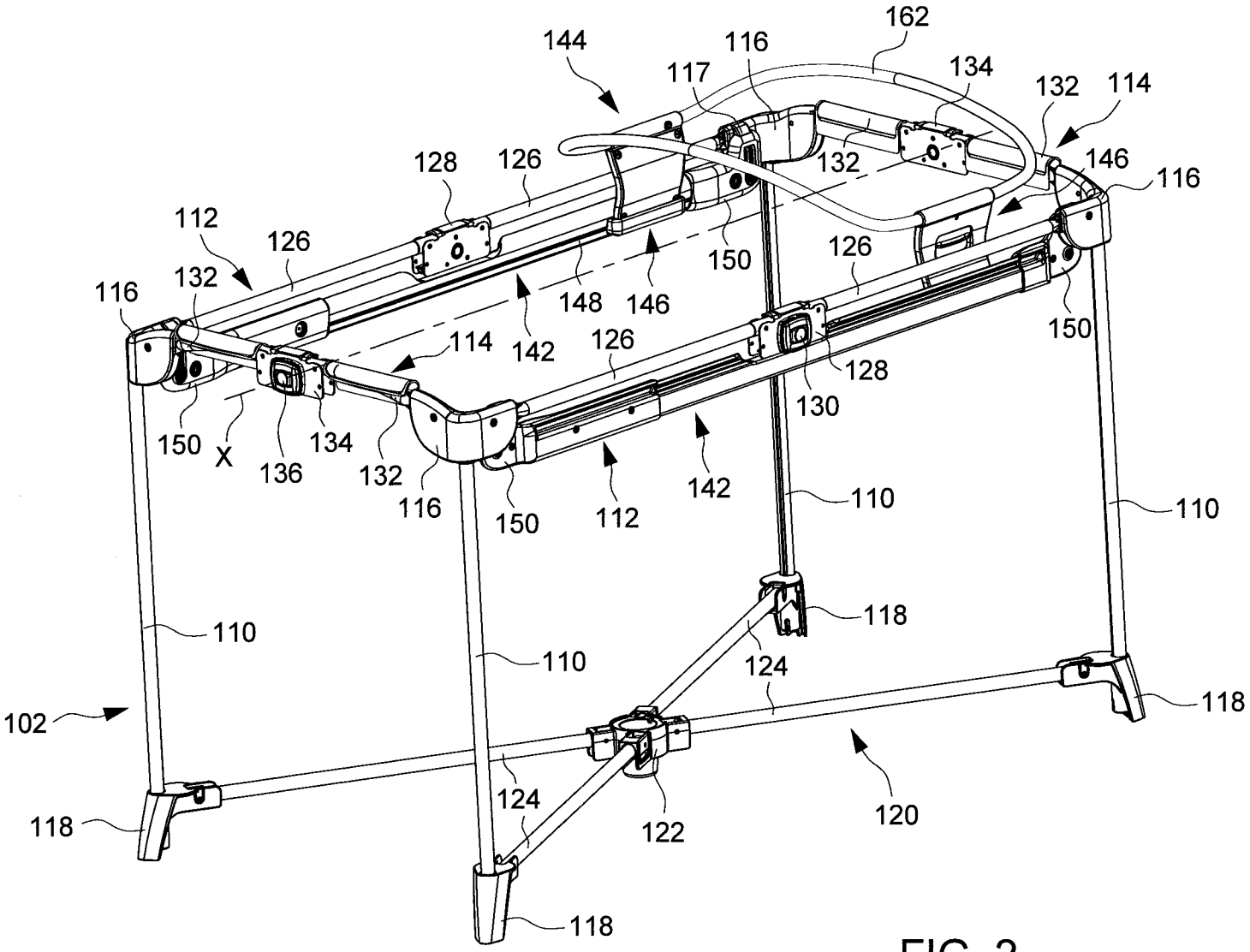
FIG. 2 is a schematic view illustrating the construction of a frame structure of the infant playpen apparatus.
Figure 3:
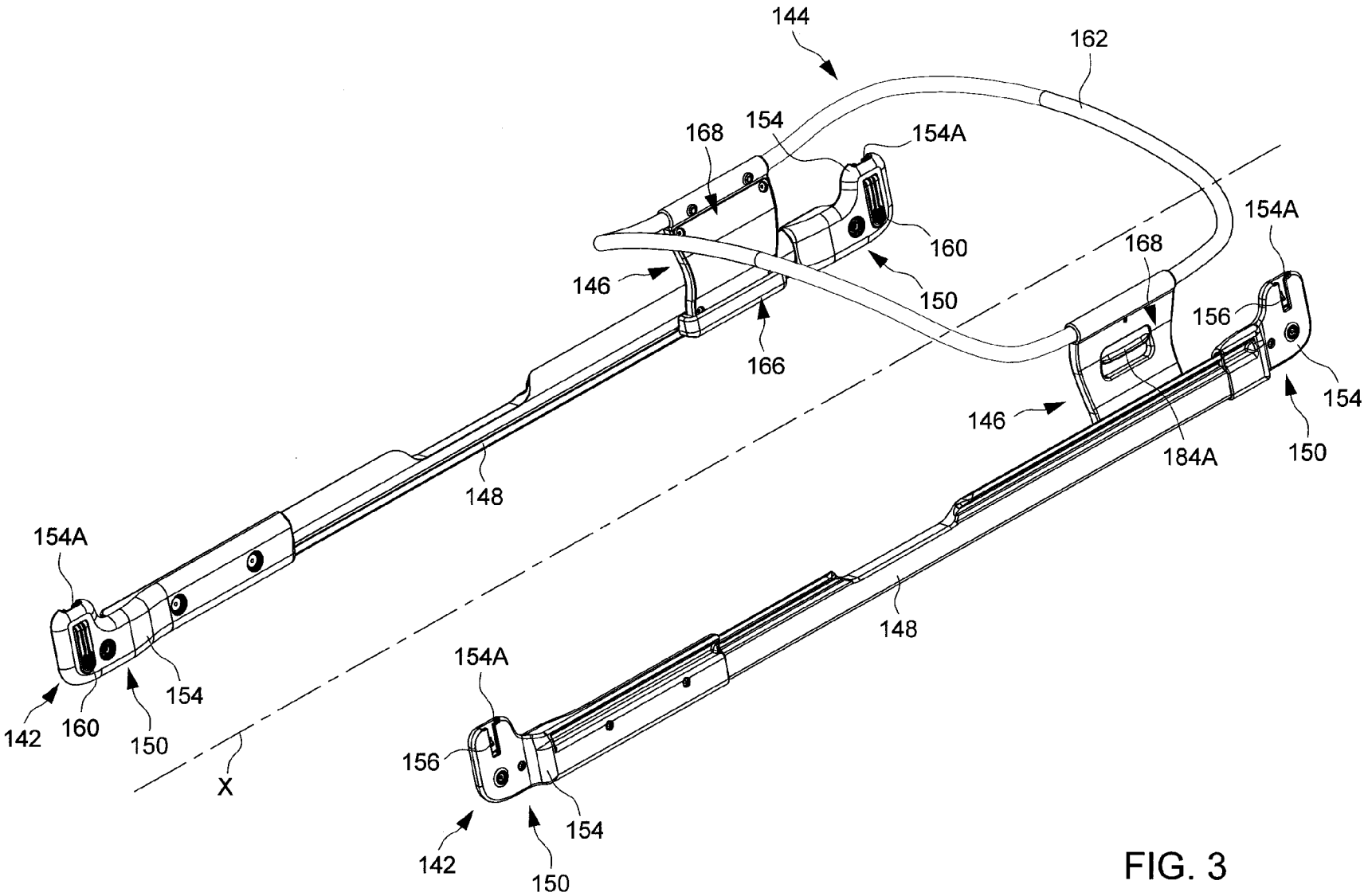
FIG. 3 is a schematic view illustrating the construction of a utility accessory assembly including two rail structures and a support platform that may be installed with the infant playpen apparatus.
Figure 4:
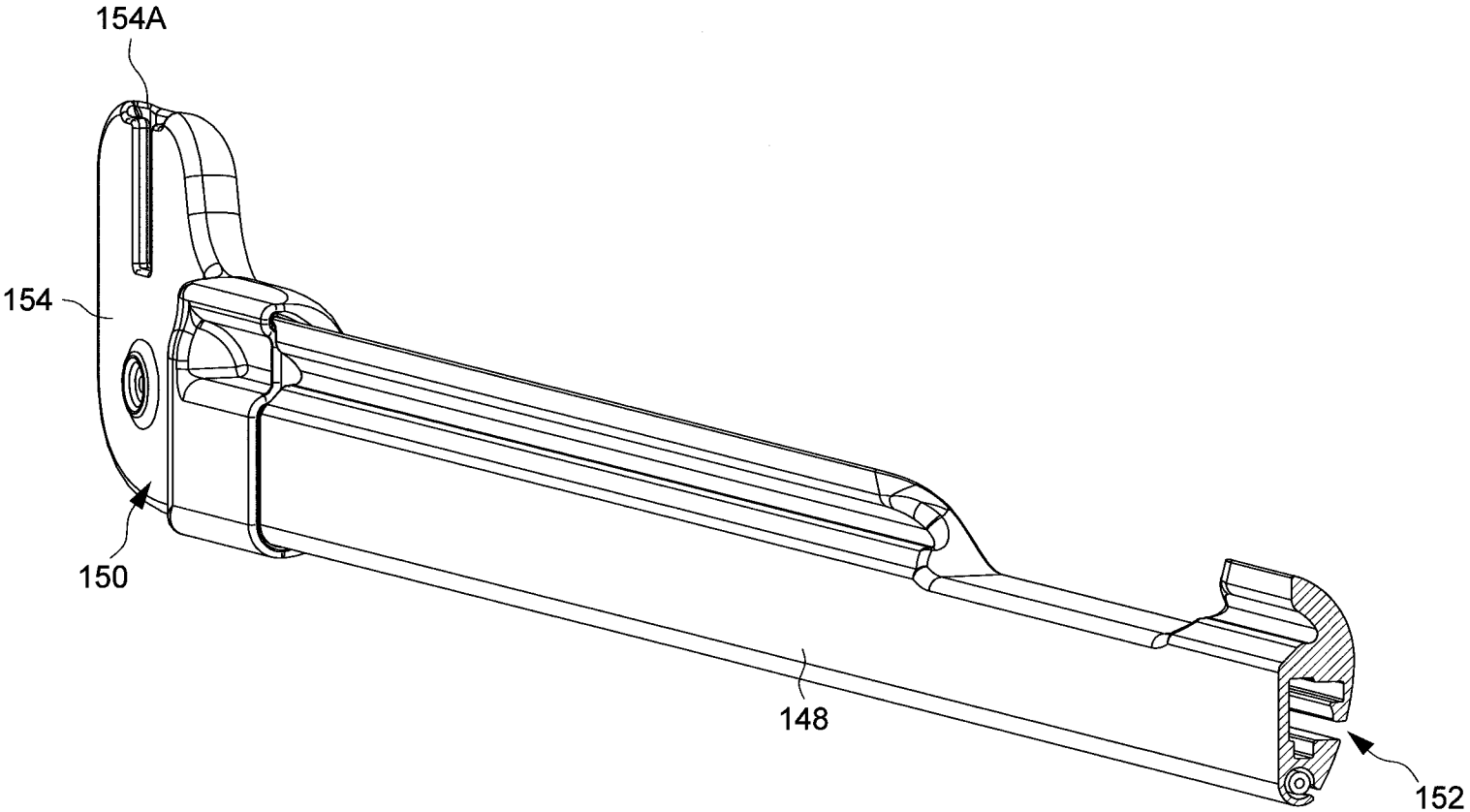
FIG. 4 is a cross-sectional view illustrating a rail segment of a rail structure used in the utility accessory assembly shown in FIG. 3.

FIG. 1 is a perspective view illustrating one embodiment of an infant playpen apparatus 100, and FIG. 2 is a schematic view illustrating the construction of a rigid frame of the infant playpen apparatus 100. The infant playpen apparatus 100 can include a playpen frame 102 formed by the assembly of multiple tube segments, and an enclosure 104 connected with the playpen frame 102 and surrounding an interior 106 of the playpen apparatus 100. The playpen frame 102 can include a plurality of corner frame portions 110, two opposite side frame portions 112 parallel to each other, and two other opposite side frame portions 114 parallel to each other and respectively connected with the side frame portions 112 via a plurality of corner joints 116.

Each of the corner frame portions 110 can be formed by an upright tubular segment that has a lower end affixed with a foot member 118, and an upper end affixed with one corner joint 116. The foot members 118 can also be pivotally connected with distal ends of a linkage assembly 120 having a cross shape. The linkage assembly 120 can include a central pivot joint 122, and four tubes 124 arranged along two diagonal directions connecting at the central pivot joint 122. The linkage assembly 120 can provide support at the bottom of the infant playpen apparatus 100.

Each of the two side frame portions 112 can be respectively formed by two tubular segments 126 pivotally connected with each other via a hinge 128 at a central location thereof. The hinge 128 can include an internal latch operable to lock the two tubular segments 126 in an unfolded state substantially aligned with each other. The hinge 128 can also include a release button 130 operable to unlock the internal latch for allowing folding of the two tubular segments 126. The ends of the two tubular segments 126 distant from the hinge 128 can be respectively affixed with two corner joints 116.

Likewise, each of the two side frame portions 114 can be respectively formed by two tubular segments 132 pivotally connected with each other via a hinge 134 at a central location thereof. The hinge 134 can include an internal latch operable to lock the two tubular segments 132 in an unfolded state substantially aligned with each other. The hinge 134 can also include a release button 136 operable to unlock the internal latch for allowing folding of the two tubular segments 132. The ends of the two tubular segments 132 distant from the hinge 134 can be respectively affixed with two corner joints 116.

The enclosure 104 can include a plurality of sidewall panels 138 respectively connected with each other along edge portions corresponding to the corner frame portions 110. The sidewall panels 138 can be made of soft goods, such as a fabric material. The sidewall panels 138 can be stretched between the corner frame portions 110 to surround an interior space of the infant playpen apparatus 100, and can have upper ends respectively secured with the side frame portions 114.

In conjunction with FIGS. 1 and 2, FIGS. 3-8 are schematic views illustrating the construction of a utility accessory assembly 140 that may be installed with the infant playpen apparatus 100. The utility accessory assembly 140 can be adapted to provide support a child at an elevated position above a bottom of the infant playpen apparatus 100. The utility accessory assembly 140 can include two rail structures 142, a support platform 144 and two coupling structures 146. The rail structures 142 can be affixed with two opposite side frame portions of the playpen frame 102 (e.g., the two side frame portions 112), and can be exposed outside the fabric material of the enclosure 104. Each of the rail structures 142 can have an elongated shape extending substantially linear along an axis X. The coupling structures 146 can be connected with two opposite sides of the support platform 144, and can be respectively assembled with the rail structures 142 for sliding displacement. The support platform 144 can be operable to move along the rail structures 142 to modify a position of the support platform 144 relative to the axis X.

Referring to FIGS. 3-7, the rail structures 142 can be operable to detachably fasten with the two side frame portions 114 of the playpen frame 102. Each of the rail structures 142 can include a rail segment 148, and two end fixtures 150 affixed with two opposite ends of the rail segment 148. The rail segment 148 can include an inner slot 152 (better shown in FIG. 4) extending along the rail segment 148 into which one associated coupling structure 142 can be at least partially received. The elongated shape of the rail segment 148 can guide the coupling structure 146 for sliding movement along the axis X.

Figure 5:
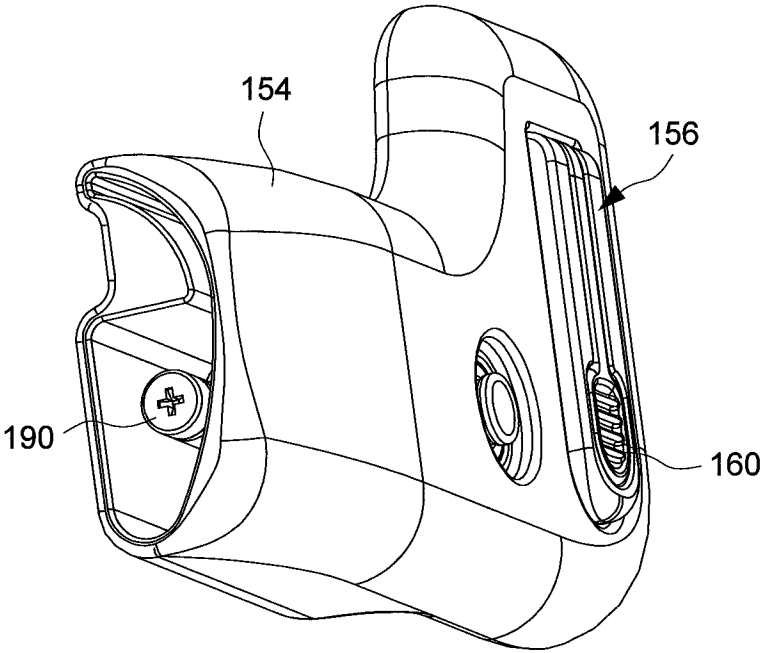
FIG. 5 is a schematic view illustrating an end fixture of the rail structure.
Figure 6:
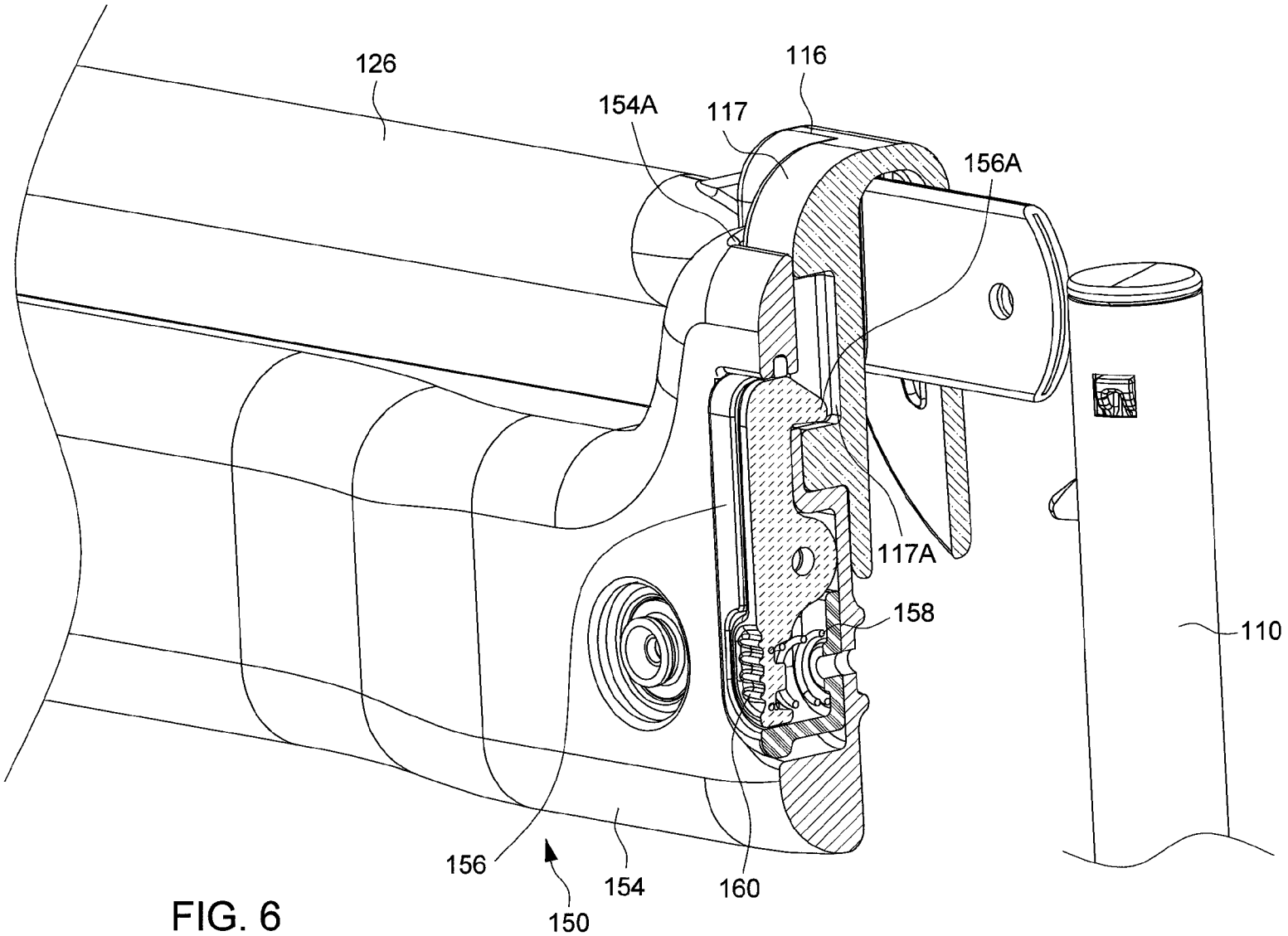
FIG. 6 is a cross-sectional view illustrating the assembly of the end fixture with a corner joint of a playpen frame.

Referring to FIGS. 5 and 6, each of the two end fixtures 150 can include a housing 154 in which are assembled a latch 156, a spring 158 and an actuator portion 160. The housing 154 can include a slot 154A adapted to receive the engagement of a protruding rib 117 (better shown in FIGS. 2 and 6) provided on the corner joint 116. The latch 156 can be pivotally connected with the housing 154 adjacent to the slot 154A, and can project outward at a side of the housing 154 facing one side frame portion 112, in particular the corner joint 116. The spring 158 can be assembled between an end of the latch 156 and an inner sidewall of the housing 154, and can bias the latch 156 in rotation to have an engaging end 156A thereof protrude outward to engage and lock with the playpen frame 102. The actuator portion 160 can be formed with the latch 156 and can be accessible from a side of the housing 154 facing the interior of the playpen frame 102. The actuator portion 160 can be operable to cause rotation of the latch 156 for disengaging the engaging end 156A from the playpen frame 102.

For installing the rail structure 142, the rail segment 148 can be disposed adjacent to one side frame portion 112. The two end fixtures 150 can be respectively mounted adjacent to the two corner joints 116, and the springs 158 in the two end fixtures 150 can respectively urge the latches 156 to engage with openings 117A (better shown in FIG. 6) provided in the ribs 117 of the corner joints 116. The rail structure 142 can be thereby attached adjacent to the corner joints 116 of the side frame portion 112, and the rail segment 148 can extend past the hinge 128 that pivotally connects the two tubular segments 126.

For detaching the rail structure 142, the actuator portion 160 at each end fixture 150 can be depressed so as to disengage the latch 156 from the corresponding corner joint 116. The rail structure 142 then can be removed from the playpen frame 102.

In some embodiment, the support platform 140 can be configured to bear the weight of a child substantially above the bottom of the infant playpen apparatus 100. For example, the support platform 140 can be a diaper changing station or a napper bed, or can be configured as a child car seat. In other embodiments, the support platform 140 may also be configured to serve as other utility accessories, such as support for placement of various objects or structures on the playpen frame 102. Referring to FIGS. 1, 2, 3 and 8, the support platform 144 can include a tubular frame 162, and a resting support 164 attached with the tubular frame 162. The tubular frame 162 can be formed by the assembly of one or more rigid tube segments. Two opposite side portions of the tubular frame 162 can be respectively connected with the coupling structures 146 through which the support platform 144 can be assembled with the rail structures 142.

The resting support 164 can include a fabric, a cushion and like soft material for comfortable contact with a child. In some embodiments, the resting support 164 may also include a rigid or resilient board (not shown) to provide better support for the child. The resting support 164 can include a plurality of sidewall portions 164A, and a bottom portion 164B connected with the sidewall portions 164A. The sidewall portions 164A can be respectively assembled with the tubular frame 162, so that the bottom portion 164B can be suspended from the tubular frame 162. The bottom portion 164B can bear the weight of a child above a bottom of the playpen frame 102.

Referring to FIGS. 3-8, the two coupling structures 146 can be assembled for sliding movement along the rail structures 142. Each of the coupling structures 146 can include a sliding connector 166 and a bracket 168. The sliding connector 166 can include an elongated bar 170, a plurality of wheels 172 assembled with the bar 170, and a mount frame 174 affixed with the bar 170. When the sliding connector 166 is movably assembled with the rail structure 142, the bar 170 and the wheels 172 can be received in the inner slot 152 of the rail segment 148, and the mount frame 174 can be placed outside the rail segment 148. The rolling contact between the wheels 172 and a sidewall of the inner slot 152 can facilitate the sliding displacement of the sliding connector 166 along the rail structure 142. The mount frame 174 can also have two opposite sidewalls 174A provided with slots 176 through which the bracket 168 can engage for locking the bracket 168 with the sliding connector 166.

Figure 8:
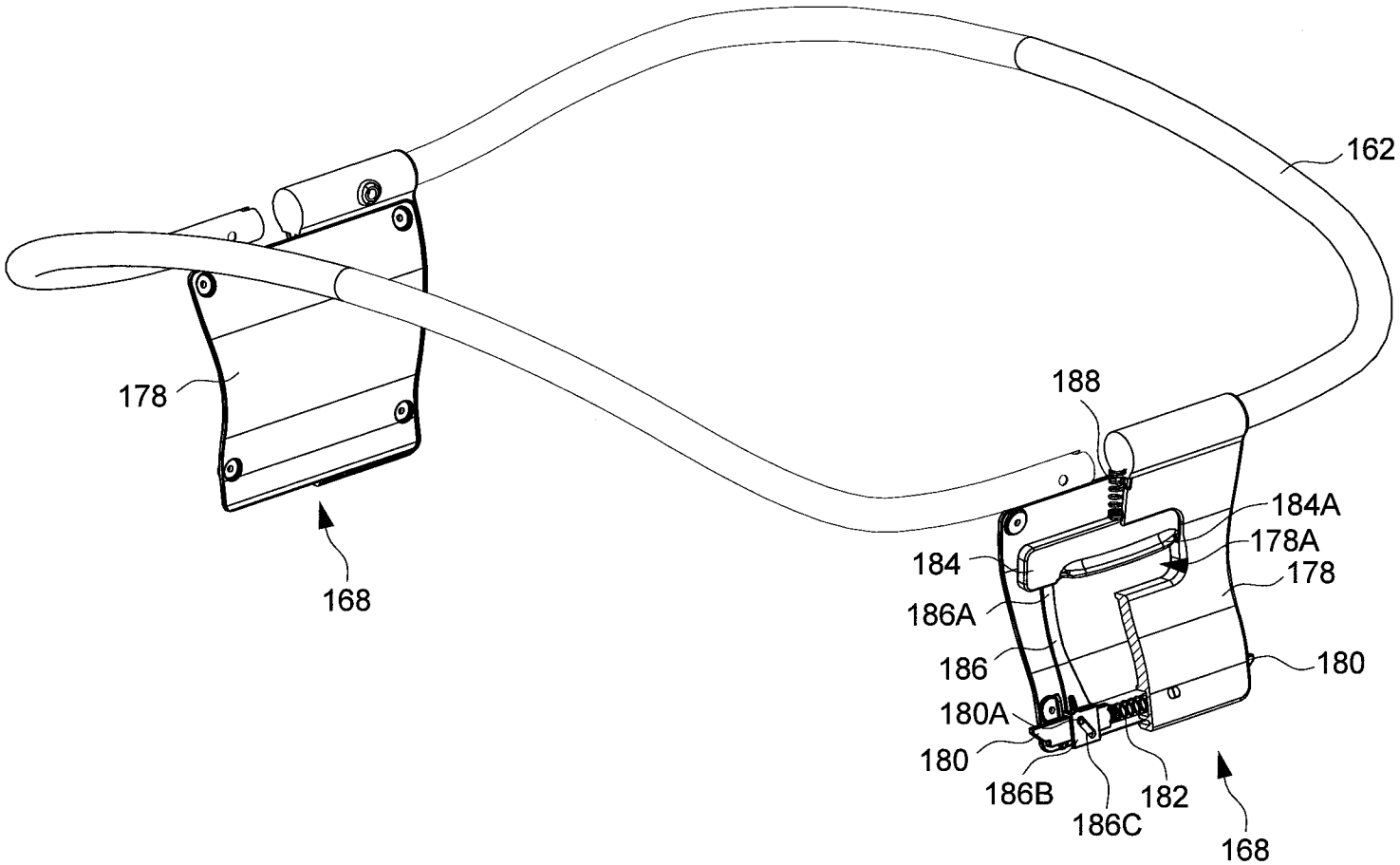
FIG. 8 is a schematic view illustrating a construction of the support platform used in the utility accessory assembly shown in FIG. 3.

The two brackets 168 can be respectively attached with two opposite portions of the tubular frame 162, and have a similar construction. In one embodiment, each of the brackets 168 can include a housing 178 in which are assembled one or more latch 180 (two latches are exemplary shown) operable to lock and unlock the assembly of the support platform 140 with the rail structure 142, a spring 182, a release button 184 and two linkage parts 186 (only one linkage part 186 is shown in FIG. 8, the other one is concealed in the housing 178 and can have a similar construction).

The housing 178 can be affixed with the tubular frame 162, and can have an opening 178A through which an actuating portion 184A of the release button 184 is exposed outward and is accessible by a caregiver for operation.

The two latches 180 can be disposed adjacent to two opposite side edges of the housing 178. The spring 182 can have two ends respectively connected with the latches 180, and can be operable to bias the latches 180 toward a locking state in which the latches 180 respectively protrude outward from the two opposite side edges of the housing 178.

The linkage parts 186 can be disposed at two sides of the actuating portion 184A of the release button 184. Each of the linkage parts 186 can have a first end 186A connected with the release button 184, and a second end 186B connected with one latch 180 associated therewith. The second end 186B of the linkage part 186 can include an angled slot 186C along which a protuberance 180A projecting from the latch 180 can be guided for sliding movement.

The release button 184 can be pushed upward to drive upward displacements of the linkage parts 186. Owing to the interaction between the protuberances 180A and the angled slots 186C, the vertical displacements of the linkage parts 186 can drive the latches 180 to move toward each other and compress the spring 182. A spring 188 can urge the release button 184 to recover an initial position when the caregiver applies no action thereon.

For installing the support platform 144 on the playpen frame 102, the rail structures 142 are first assembled with the playpen frame 102 adjacent to the two side frame portions 112 by locking the end fixtures 150 with the corner joints 116 as previously described. The two brackets 168 then can be respectively inserted through the mount frames 174 of the two sliding connectors 166, until the latches 180 urged by the spring 182 can engage with the slots 176 to lock the brackets 168 with the sliding connectors 166. The latches 180 of the coupling fixtures 146 can thereby lock the assembly of the support platform 144 with the two rail structures 142. The caregiver then can easily slide the support platform 144 along the rail structures 142 until it reaches a desirable position. The length of the rail segment 148 is such that the coupling structure 146 can slide from one end portion of the rail segment 148 adjacent to one end fixture 150, and travel past the hinge 128 that connects the two tubular segments 126 to the other end portion of the rail segment 148 adjacent to the other end fixture 150.

In one embodiment, each of the rail structures 142 can also include a plurality of spaced-apart magnets 190 operable to hold the support platform 144 at different positions along the axis X. FIGS. 2 and 5 illustrate one exemplary placement in which two magnets 190 can be affixed adjacent to the two end fixtures 150. When the coupling fixture 146 is located adjacent to one of the two end fixtures 150, the corresponding magnet 190 can apply a magnetic attraction force on the coupling structure 146 to keep the support platform 144 in position.

Figure 7:
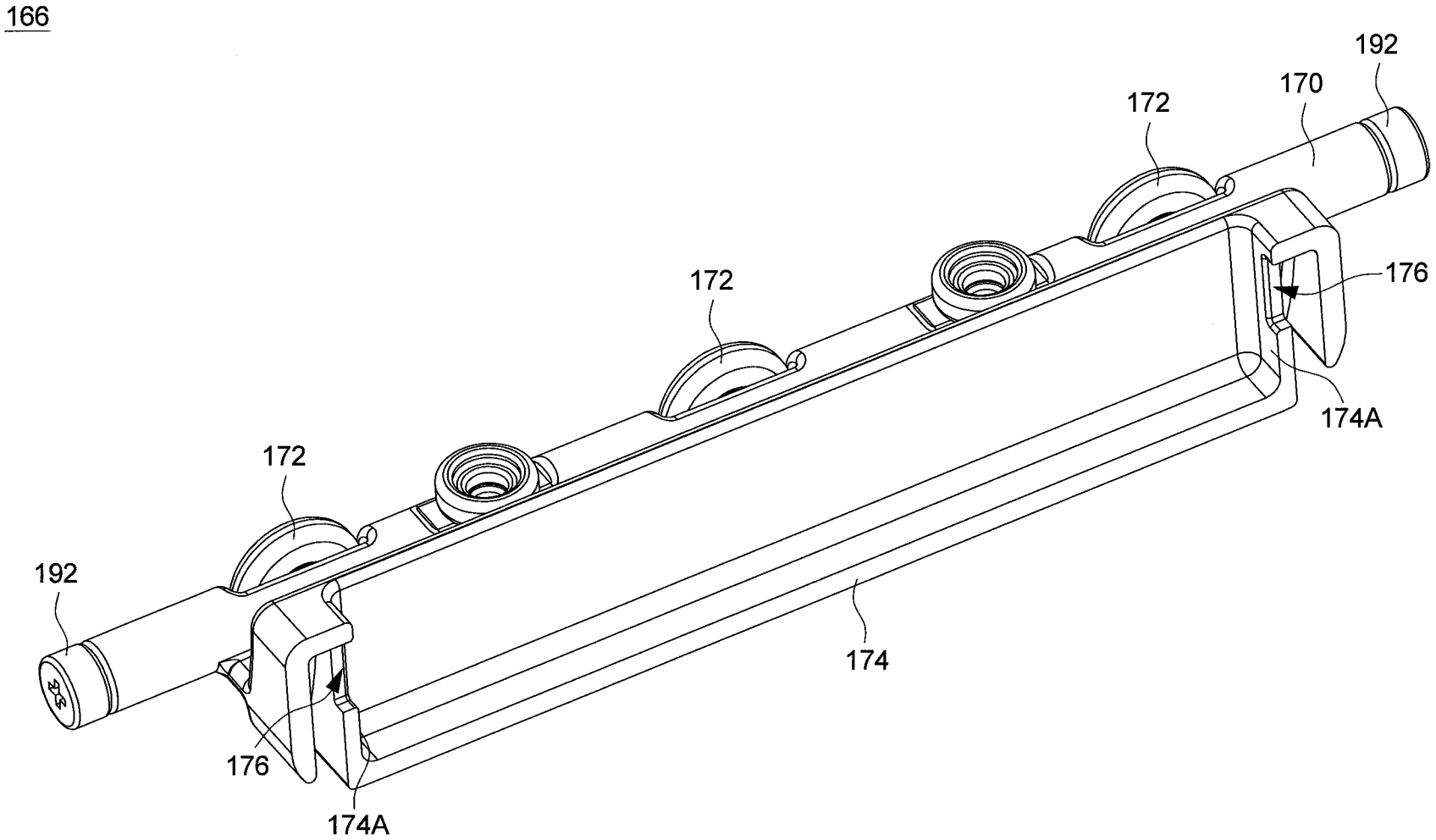
FIG. 7 is a schematic view illustrating a sliding connector of a coupling structure used in the utility accessory assembly shown in FIG. 3.

Each of the coupling structures 146 can also include one or more magnets 192 adapted to interact with any of the magnets 190 in the rail structure 142. In FIG. 7, one exemplary placement is shown in which two spaced-apart magnets 192 can be affixed adjacent to two opposite ends of the sliding connector 166. When the coupling fixture 146 is positioned adjacent to one of the two end fixtures 150, an attraction force can be produced between one of the two magnets 192 in the sliding connector 166 and the magnet 190 in the adjacent end fixture 150 to keep the support platform 144 in position. When the coupling fixture 146 is placed at an opposite position adjacent to the other one of the two end fixtures 150, an attraction force can be produced between the other one of the two magnets 192 in the sliding connector 166 and the magnet 190 in the other end fixture 150 to keep the support platform 144 in position.

It is worth noting that one or more additional magnet 190 may also be provided in the rail structure 142 at any intermediate positions between the two end fixtures 150 for holding the support platform 144 in intermediate positions between the two end fixtures 150.

For removing the support platform 144 from the playpen frame 102, the caregiver can operate the release button 184 at each of the brackets 168, which cause displacement of the latch 180 to unlock the brackets 168 from the sliding connectors 166, thereby unlocking the assembly of the support platform 144 with the playpen frame 102. The support platform 144 and the brackets 168 then can be easily removed from the rail structures 142.

In case the playpen frame 102 is to be collapsed, the actuator portions 160 can be depressed so as to unlock the end fixtures 150 from the corner joints 116. The rail structures 142 then can be removed from the side frame portions 112.

Figure 9:
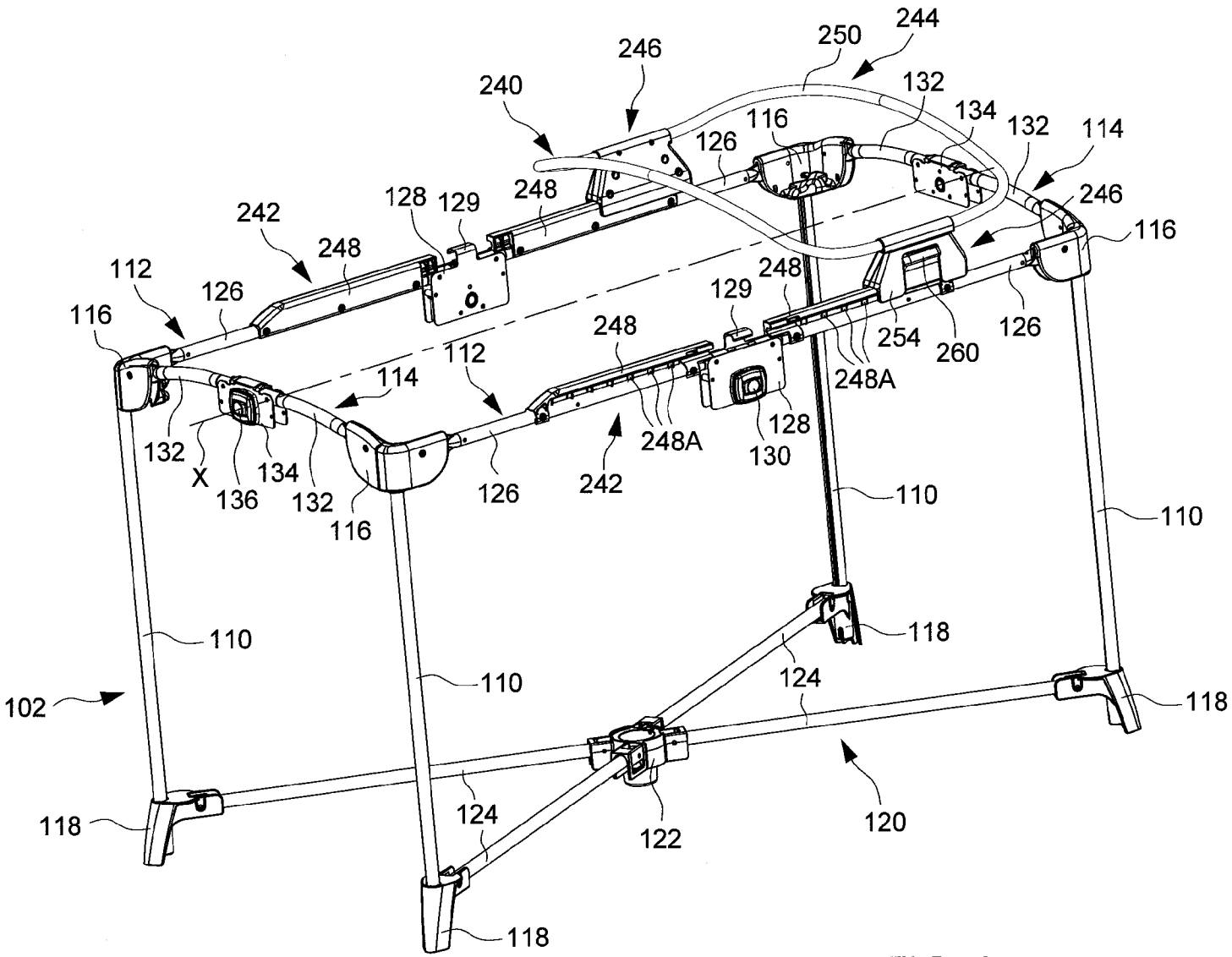
FIG. 9 is a perspective view illustrating another embodiment of a utility accessory assembly installed with the infant playpen apparatus.
Figure 10:
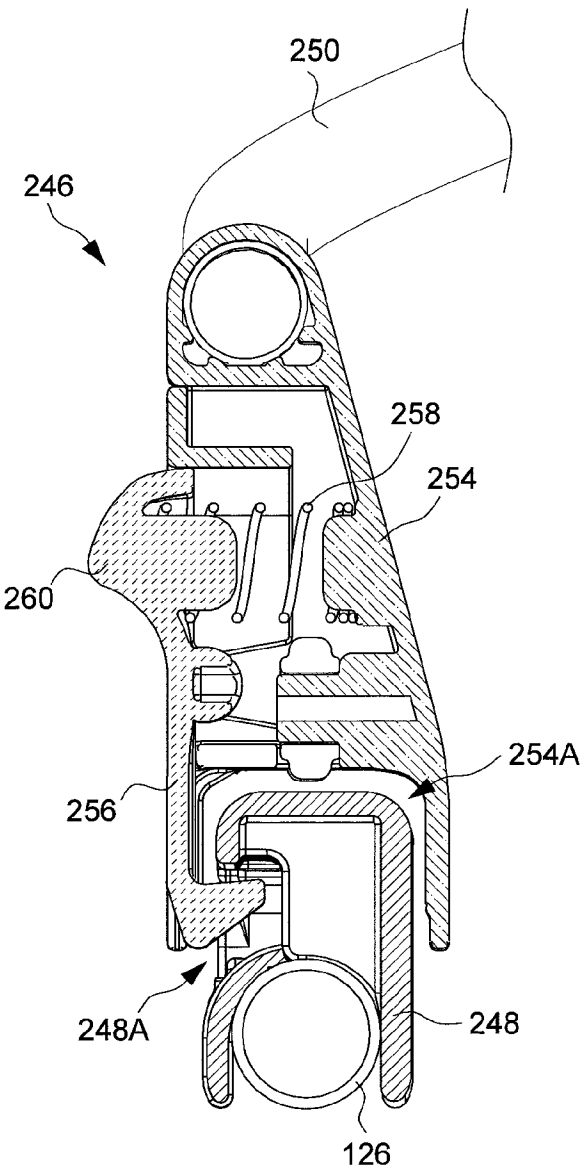
FIG. 10 is a cross-sectional view illustrating the utility accessory assembly shown in FIG. 9 locked with the playpen frame.

FIGS. 9 and 10 are respectively perspective and cross-sectional views illustrating another embodiment of a utility accessory assembly 240 that may be installed with the infant playpen apparatus 100. The utility accessory assembly 240 can likewise include two rail structures 242 affixed with the two side frame portions 112 of the playpen frame 102, a support platform 244 adapted to provide support for a child, and two coupling structures 246 connected with two opposite sides of the support platform 244 that can respectively assemble with the two rail structures 242 for sliding displacement along the axis X.

In this embodiment, each of the two rail structures 242 can include two rail segments 248 that are respectively affixed with the two tubular segments 126 of one associated side frame portion 112. Moreover, each of the rail segments 248 can include a plurality of locking grooves 248A spaced apart from one another along the axis X.

Like previously described, the support platform 244 can include a tubular frame 250, and a resting support (not shown for clarity) attached with the tubular frame 250. Two opposite side portions of the tubular frame 250 can be respectively connected with the coupling structures 246 through which the support platform 244 can be assembled with the rail structures 242.

The two coupling structures 246 can be assembled for sliding movement along the rail structures 242. In this embodiment, each of the coupling structures 246 can include a housing 254, a latch 256, a spring 258 and an actuating portion 260. The housing 254 can be affixed with the tubular frame 250 of the support platform 244, and can include a recess 254A into which an upper portion of the rail structure 242 (in particular the rail segment 248) can be movably assembled. The latch 256 can be pivotally assembled with the housing 254, and can be operable to engage with any of the locking grooves 248A of the rail structure 242. The spring 258 can have a first and a second end respectively connected with the latch 256 and an inner sidewall of the housing 254, and can be operable to urge the latch 256 to a locking state. The actuating portion 260 can be formed with the latch 256 can be accessible from the outside of the housing 254 for operation.

For installing the support platform 244 on the playpen frame 102, the two coupling fixtures 246 can be arranged on the rail structures 242 such that the rail segments 248 are respectively received in the recesses 254A of the housings 254. The support platform 244 then can be moved along the rail structures 242 until it reaches a desirable position. The length of the rail segments 248 at each of the two side frame portions 112 is such that the coupling structure 246 can travel from one rail segment 248 past the hinge 128 to the other rail segment 248 The hinge 128 may also include a tab 129 that can facilitate the passage of the coupling structure 246 past the hinge 128. Once the support platform 244 reaches a desired position, the latch 256 biased by the spring 258 can engage with one corresponding locking groove 248A of the rail structure 242 to lock the support platform 244 in position. The engagement of the latch 256 can accordingly lock the assembly of the support platform 244 with the rail structure 242, and also hold the support platform 244 in place.

When the support platform 244 is to be removed, the actuating portions 260 can be operated to disengage the latches 256 from corresponding locking grooves 248A. The support platform 244 then can be easily detached from the rail structures 242. With the construction shown in FIGS. 9 and 10, the rail structures 242 can remain attached with the playpen frame 102 when the playpen frame 102 is folded to a collapse state.

Figure 11:
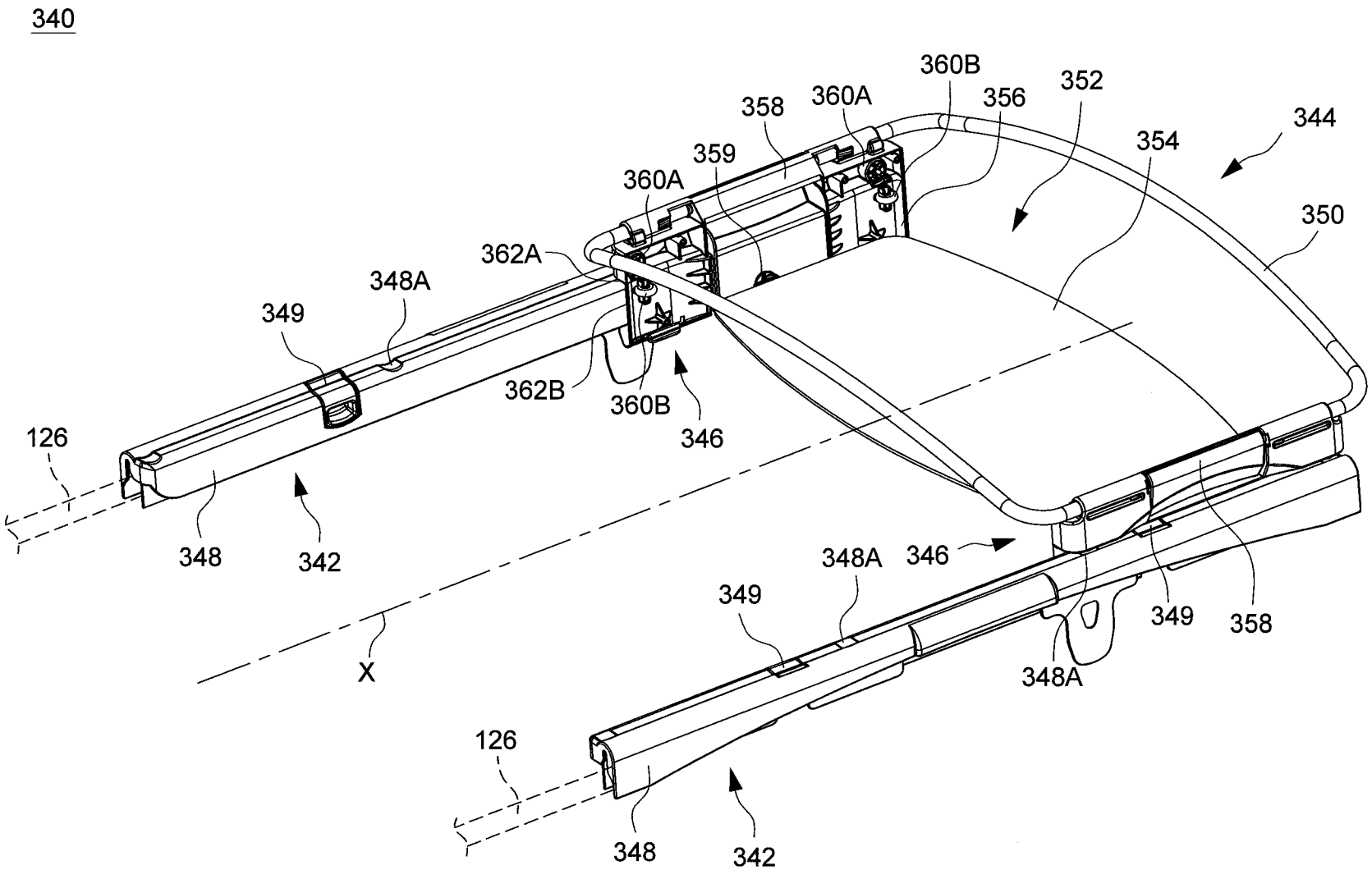
FIG. 11 is a perspective view illustrating another embodiment of a utility accessory assembly.
Figure 12:
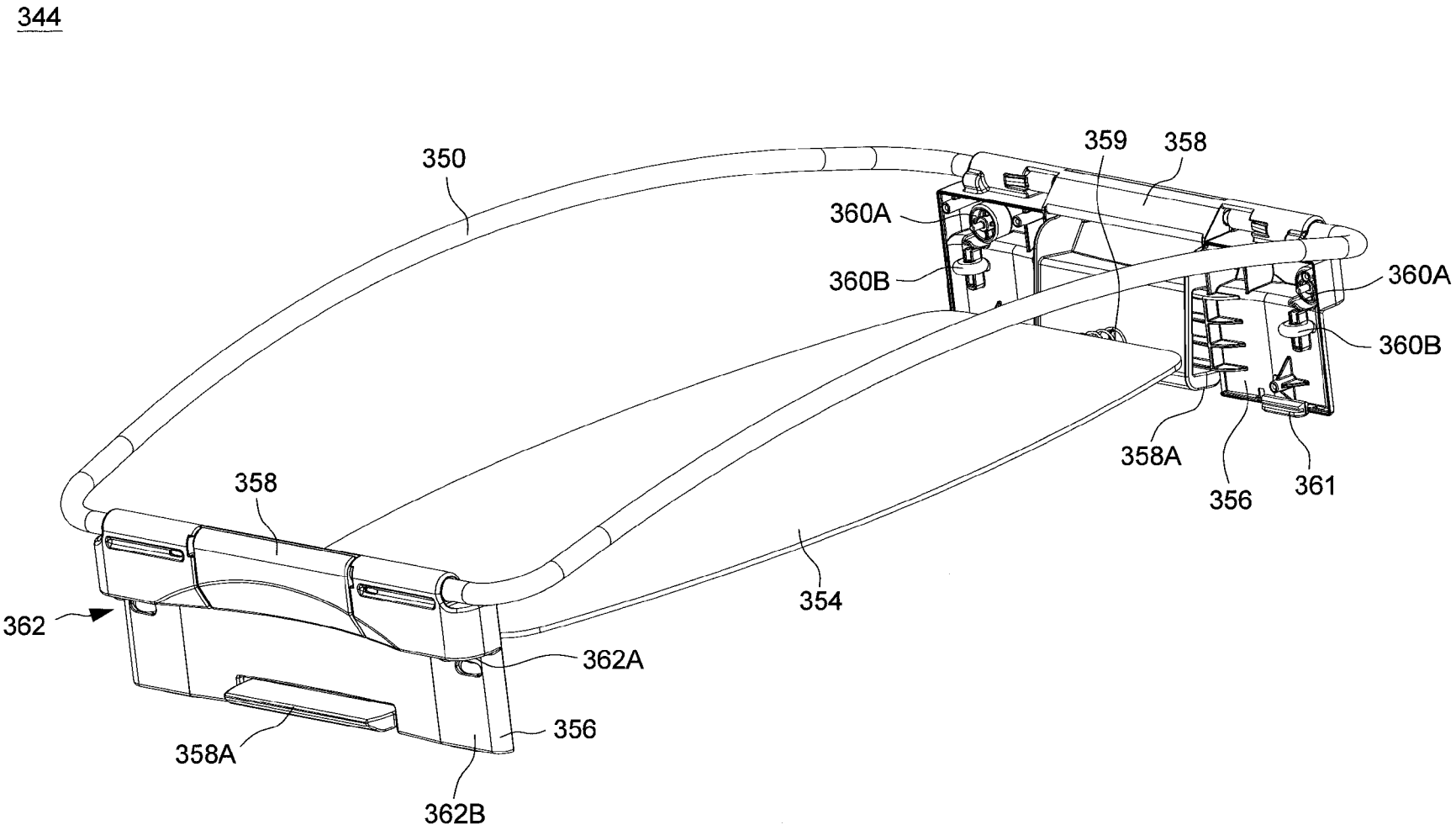
FIG. 12 is a schematic view illustrating a support platform used in the utility accessory assembly shown in FIG. 11.

FIGS. 11 and 12 are schematic views illustrating another embodiment of a utility accessory assembly 340 suitable for use with the playpen frame 102. Like previously described, the utility accessory assembly 340 can include two rail structures 342 affixed with the two side frame portions 112 of the playpen frame 102, a support platform 344 adapted to provide support for a child, and two coupling structures 346 connected with two opposite sides of the support platform 344 that can respectively assemble with the two rail structures 342 for sliding displacement along the axis X.

Each of the two rail structures 342 can include a rail segment 348 that can be affixed with the two tubular segments 126 of one side frame portion 112. The rail segment 348 can include a plurality of spaced-apart latches 349. Each of the latches 349 can be pivotally connected with the rail segment 348, and have an inward projecting portion adapted to hook around one tubular segment 126 to lock the rail segment 348 with the tubular segment 126. An upper surface of the rail segment 348 can also include a plurality of positioning recesses 348A spaced apart from one another along the axis X and associated with different predetermined positions of the support platform 344.

Like previously described, the support platform 344 can include a tubular frame 350, and a resting support 352 attached with the tubular frame 350. The resting support 352 can include a fabric, a cushion and like soft material for comfortable contact with a child. Moreover, the resting support 352 may also include a rigid or resilient board 354 to provide better support for the child. Two opposite side portions of the tubular frame 350 can be respectively connected with the coupling structures 346 through which the support platform 344 can be assembled with the rail structures 342.

The two coupling structures 346 can be assembled for sliding movement along the rail structures 342, and can be similar in construction. Each of the coupling structures 346 can include a housing 356, a latch 358 and a plurality of wheels 360A and 360B.

The housing 356 can include a mount portion 362 adapted to receive the placement of the rail segment 348 of the rail structure 342. The mount portion 362 can have reverse L-shape including a downwardly facing surface 362A, and a side surface 362B connected with the downwardly facing surface 362A. A bottom surface of the housing 356 can also include a plurality of resting pads 361, which can allow the support platform 344 to stand on a ground surface in a stable manner when it is not used with the playpen frame 102.

The latch 358 can be pivotally connected with the housing 356 about a pivot axis substantially parallel to the axis X. The latch 358 can have a flange 358A that can lie vertically below the downwardly facing surface 362A. A spring 359 may be assembled adjacent to the latch 358. The spring 359 can bias the latch 358 to a locking position in which the flange 358A lies vertically below the downwardly facing surface 362A.

The wheels 360A and 360B can be pivotally connected with the housing 356, and can be in rolling contact with the rail structure 342 when the support platform 344 is installed on the playpen frame 102. The wheels 360A and 360B can be in rolling contact with different surfaces of the rail structure 342: for example, the wheels 360A can be in rolling contact with an upper surface of the rail segment 348, and the wheels 360B can be in rolling contact with a lateral surface of the rail segment 348.

For installing the support platform 344 on the playpen frame 102, the latches 358 of the coupling structures 346 can be first rotated relative to the housing 356 so that the flanges 358A are respectively retracted inward from the side surfaces 362B of the mount portions 362. The support platform 344 then can be installed such that the coupling structures 346 respectively rest on the rail structures 342, the side surfaces 362B of the housings 356 respectively lying adjacent to the inner sides of the rail segments 348. Owing to the action of the springs 359, the latches 358 then can be rotated such that the flanges 358A can respectively protrude outward from the side surfaces 362B to hook downwardly around the rail structures 342, which can prevent upward removal of the support platform 344. The support platform 344 can be thereby held in place with the rail structures 342 by the latches 358.

The caregiver then can slide the support platform 344 along the rail structures 342 until it reaches a desired position. When the support platform 344 reaches a desired position, the wheels 360A can be positioned in corresponding recesses positioning recesses 348A of the rail structures 342. The engagement of the wheels 360A with the recesses 348A can help to keep the support platform 344 in position and prevents its displacement. Should the support platform 344 be adjusted from one position to another one, the caregiver can draw displacement of the support platform 344 so that the wheels 360A can roll past the recesses 348A.

For removing the support platform 344 from the playpen frame 102, the latches 358 of the coupling structures 346 can be first rotated relative to the housing 356 so that the flanges 358A are respectively retracted inward from the side surfaces 362B of the mount portions 362. The support platform 344 then can be upwardly moved away from the playpen frame 102.

The sliding constructions of the utility accessory assemblies 140, 240 and 340 can allow convenient adjustment on the playpen frame. Moreover, the infant playpen apparatus can also include other diverse utility accessories that may be used in association with any of the utility accessory assemblies 140, 240 or 340.

Figure 13:
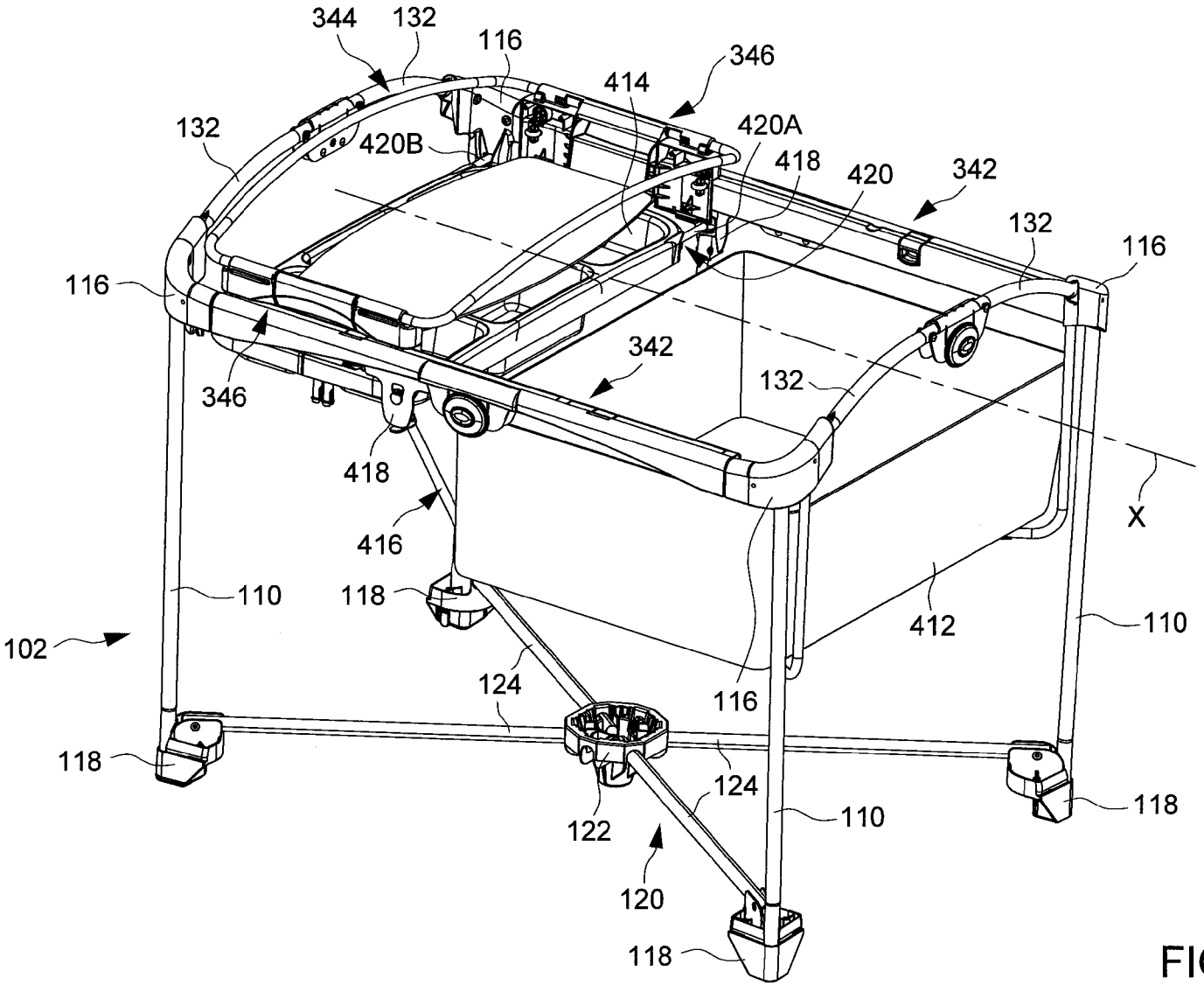
FIG. 13 is a schematic view illustrating an infant playpen apparatus provided with multiple utility accessories.
Figure 14:
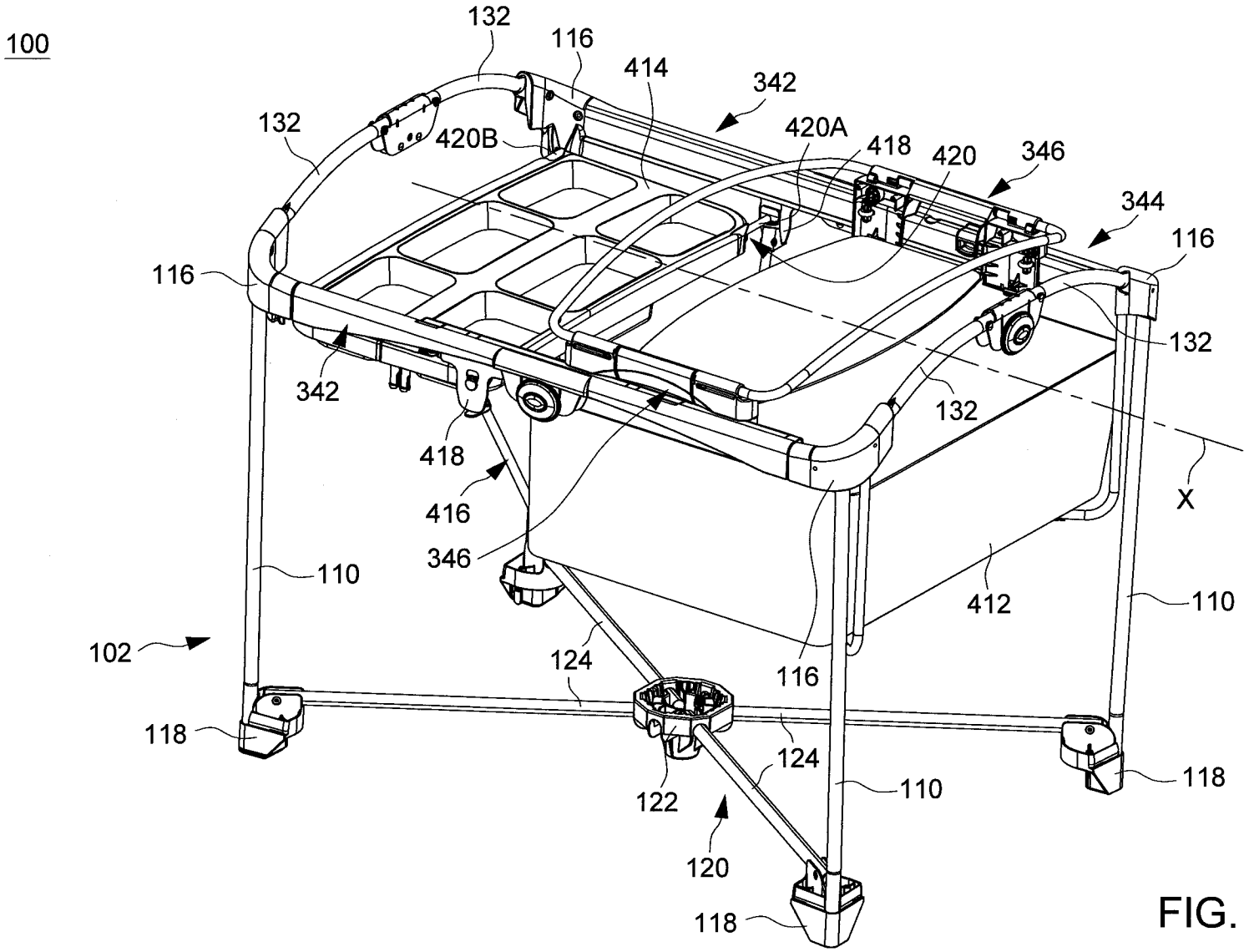
FIG. 14 is a schematic view illustrating the support platform shown in FIG. 13 adjusted to another position in the infant playpen apparatus.

FIGS. 13 and 14 are schematic views illustrating an embodiment of the infant playpen apparatus 100 provided with the rail structures 342, and the support platform 344 installed on the rail structures 342 via the coupling structures 346. In addition, the infant playpen apparatus 100 can include a bassinet 412, and an organizer rack 414 in which diverse articles can be placed (e.g., diapers, feeder bottles, etc.). The bassinet 412 can be supported by a tubular frame 416 that can be respectively affixed with the two rail structures 342 and two corner joints 116. For example, each of the two rail structures 342 can include a mount bracket 418 where distal ends of the tubular frame 416 can be detachably fastened.

The organizer rack 414 can be placed adjacent to the bassinet 412 along the axis X. The organizer rack 414 can be supported by a frame assembly 420 that is detachably affixed with the two rail structures 342 and the two other corner joints 116. For example, the frame assembly 420 can include a first tube segment 420A affixed with the mount brackets 418 of the rail structures 342, and a second tube segment 420B affixed with two corner joints 116. Multiple recesses may be provided in the organizer rack 414 for facilitating placement of diverse objects therein.

During use, the support platform 344 can be desirably moved along the rail structures 342 between multiple positions, e.g., a first position where the support platform 344 substantially uncovers the bassinet 412 and is located above and substantially overlaps with the organizer rack 414 (as shown in FIG. 13), and a second position where the support platform 344 substantially uncovers the organizer rack 414 and is located above and substantially overlaps with the bassinet 412 (as shown in FIG. 14). For example, the support platform 344 can be placed in the aforementioned first position for transferring the child between the bassinet 412 and the support platform 344, and in the second position when the caregiver wants to access the exposed organizer rack 414 and change diapers of the child placed on the support platform 344.

It can be understood that the bassinet 412 and the organizer rack 414 shown in FIGS. 13 and 14 can also be used with other constructions of the rail structures and the support platform. For example, the bassinet 412, the organizer rack 414, the tubular frame 416 and the frame assembly 420 may be associated with the accessory assemblies 140 or 240 described previously.

When they are not used, the bassinet 412 and the organizer rack 414 can be removed from the interior of the playpen frame 102, and the tubular frame 416 and the frame assembly 420 can be detached and removed from the infant playpen apparatus 100.

Advantages of the structures described herein include the ability of providing a utility accessory assembly that can be adjustable between different positions. The utility accessory assembly can include a support platform that can desirably slide along two rail structures affixed on the playpen frame. Moreover, the infant playpen apparatus can also include utility accessories including a bassinet and an organizer rack that may be conveniently used in association with the utility accessory assembly. While the movable support platforms have been described as supports for placement of a child, the same adjustable constructions may also be applied for other types of utility accessories. For example, the support platforms may also be configured as a bassinet or organizer rack movable along the rail structures.

Therefore, realizations of the playpen apparatus and related accessories have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A utility accessory assembly suitable for use with a playpen, comprising:

a generally horizontal rail structure operable to affix with a playpen frame;

a support platform operable to assemble with and detach from the rail structure; and a coupling structure operable to slide along the rail structure, wherein the coupling structure includes a latch operable to restrain the support platform to remain with the rail structure, and to release the support platform for its removal from the rail structure, the support platform and the coupling structure being movable in unison along the rail structure.

2. The utility accessory assembly according to claim 1, wherein the support platform includes a tubular frame, the coupling structure includes a housing affixed with the tubular frame, and the latch is assembled with the housing, the latch being operable to engage with the rail structure to lock the support platform in place, and to disengage from the rail structure so that the support platform and the coupling structure are movable together along the rail structure.

3. The utility accessory assembly according to claim 1, wherein the rail structure includes a plurality of spaced-apart locking grooves, and the latch is biased by a spring to engage with any of the grooves to lock the support platform in position.

4. The utility accessory assembly according to claim 1, wherein the rail structure includes two rail segments adapted to affix with two tubular segments of the playpen frame, and the coupling structure is operable to slide along one of the two rail segments, travel past a hinge that pivotally connects the two tubular segments, and slide along the other one of the two rail segments.

5. The utility accessory assembly according to claim 1, wherein the coupling structure includes:

a sliding connector assembled with the rail structure for sliding movement; and a bracket affixed with the support platform, the bracket being operable to assemble with the sliding connector for installing the support platform on the playpen frame, and to disassemble from the sliding connector for removing the support platform from the playpen frame.

6. The utility accessory assembly according to claim 5, wherein the bracket includes a housing in which is assembled the latch, a spring arranged in the housing and biasing the latch to engage with the sliding connector to lock the bracket with the sliding connector, and a release button operable to drive the latch to disengage from the sliding connector.

7. The utility accessory assembly according to claim 1, wherein the coupling structure is assembled with one or more wheel in rolling contact with the rail structure to facilitate displacement of the support platform along the rail structure.

8. The utility accessory assembly according to claim 7, wherein the rail structure includes a plurality of recesses, and at least one of the wheel is positioned in one of the recesses to prevent sliding of the support platform.

9. The utility accessory assembly according to claim 1, wherein the rail structure is provided with a plurality of first spaced-apart magnets, and the coupling structure includes at least one second magnet adapted to interact with one of the first magnets provided in the rail structure to hold the support platform in position.

10. The utility accessory assembly according to claim 1, wherein the coupling structure includes a housing having a mount portion adapted to receive the placement of the rail structure, the mount portion of the housing having a reverse L-shape including a downwardly facing surface, and the latch is pivotally connected with the housing and has a flange, the latch being operable to rotate relative to the housing to a position where the flange lies vertically below the downwardly facing surface for restraining the rail structure between the downwardly facing surface and the flange.

11. The utility accessory assembly according to claim 1, wherein the rail structure includes a rail segment, and an end fixture affixed with the rail segment and operable to attach with a corner joint of a playpen frame.

12. The utility accessory assembly according to claim 11, wherein the end fixture includes a second latch, a spring biasing the second latch to engage with a corner joint of a playpen frame, and an actuator portion operable to drive the second latch to disengage from the corner joint.

13. The utility accessory assembly according to claim 1, wherein the rail structure includes a rail segment, and another latch pivotally connected with the rail segment and operable to hook around a tubular segment of a playpen frame to attach the rail segment with the playpen frame.

14. The utility accessory assembly according to claim 1, wherein the support platform is configured to bear the weight of a child above a bottom of a playpen frame.

15. The utility accessory assembly according to claim 1, wherein the rail structure has a first and a second distal end opposite to each other, and the support platform is movable along the rail structure between a first position where the support platform lies adjacent to the first distal end and distant from the second distal end, and a second position where the support platform lies adjacent to the second distal end and distant from the first distal end.

16. The utility accessory assembly according to claim 1, wherein the support platform includes a tubular frame, the coupling structure includes a housing affixed with the tubular frame, and the latch is assembled with the housing, the latch having a disengaged state in which removal of the support platform from the rail structure is allowed, and an engaged state for restraining the support platform to remain on the rail structure while allowing displacement of the support platform along the rail structure.

17. An infant playpen apparatus comprising:

a playpen frame having two opposite and parallel side frame portions;

two generally horizontal rail structures respectively affixed with the two side frame portions of the playpen frame;

a support platform operable to assemble with and detach from the rail structures;

two coupling structures connected with the support platform and operable to respectively assemble with the two rail structures for sliding displacement, wherein the support platform and the coupling structures are operable to slide along the rail structures; and a bassinet removably held with the playpen frame below the support platform, wherein the support platform is operable to slide along the rail structures between a first position where the support platform substantially uncovers the bassinet, and a second position where the support platform lies above and substantially overlaps with the bassinet.

18. The infant playpen apparatus according to claim 17, wherein at least one of the coupling structures includes one or more wheel in rolling contact with the rail structure associated therewith.

19. The infant playpen apparatus according to claim 18, wherein at least one of the rail structures includes a plurality of recesses, and at least one of the wheel is positioned in one of the recesses to prevent sliding of the support platform.

20. The infant playpen apparatus according to claim 17, wherein the support platform includes a tubular frame, at least one of the two coupling structures includes a housing affixed with the tubular frame, and a latch that is assembled with the housing and is operable to engage with one corresponding rail structure to lock the support platform in place, and to disengage from the rail structure for displacement of the support platform along the rail structure.

21. The infant playpen apparatus according to claim 20, wherein the corresponding rail structure includes a plurality of spaced-apart locking grooves, and the latch is biased by a spring to engage with any of the grooves to lock the support platform in position.

22. The infant playpen apparatus according to claim 17, wherein at least one of the two rail structures includes two rail segments adapted to affix with two tubular segments of one side frame portion, and the corresponding coupling structure is operable to slide along one of the two rail segments, travel past a hinge that pivotally connects the two tubular segments, and slide along the other one of the two rail segments.

23. The infant playpen apparatus according to claim 17, wherein at least one of the two coupling structures includes:

a sliding connector assembled with one rail structure associated therewith for sliding movement; and a bracket affixed with the support platform, the bracket being operable to assemble with the sliding connector for installing the support platform on the playpen frame, and to disassemble from the sliding connector for removing the support platform from the playpen frame.

24. The infant playpen apparatus according to claim 23, wherein the bracket includes a housing in which is assembled a latch, a spring biasing the latch to engage with the sliding connector to lock the bracket with the sliding connector, and a release button operable to drive the latch to disengage from the sliding connector.

25. The infant playpen apparatus according to claim 17, wherein at least one of the two rail structures is provided with a plurality of first spaced-apart magnets, and the corresponding coupling structure includes at least one second magnet adapted to interact with one of the first magnets to hold the support platform in position.

26. The infant playpen apparatus according to claim 17, wherein the playpen frame includes at least two corner joints, and at least one of the two rail structures includes a rail segment, and two end fixtures affixed with two end portions of the rail segment, the end fixtures being respectively attached with the two corner joints of the playpen frame.

27. The infant playpen apparatus according to claim 26, wherein the rail structure is assembled with the playpen frame adjacent to two tubular segments thereof, and the rail segment extends past a hinge that pivotally connects the two tubular segments.

28. The infant playpen apparatus according to claim 27, wherein the hinge includes a tab that facilitates the passage of the coupling structure past the hinge.

29. The infant playpen apparatus according to claim 17, wherein at least one of the two rail structures includes a rail segment, and a latch pivotally connected with the rail segment and operable to hook around a tubular segment of the corresponding side frame portion to attach the rail segment with the playpen frame.

30. The infant playpen apparatus according to claim 17, wherein the bassinet is supported by a tubular frame that is attached with the two rail structures.

31. The infant playpen apparatus according to claim 17, further including an organizer rack held with the playpen frame at a position adjacent to the bassinet.

32. The infant playpen apparatus according to claim 31, wherein the support platform when in the first position is located above and substantially overlaps with the organizer rack, and the support platform when in the second position substantially uncovers the organizer rack.

33. The infant playpen apparatus according to claim 17, wherein the support platform is configured to bear the weight of a child above a bottom of the playpen frame.

34. The infant playpen apparatus according to claim 17, wherein each of the two rail structures has a first and a second distal end opposite to each other, and the support platform is movable along the rail structure between a first position where the support platform lies adjacent to the first distal ends and distant from the second distal ends, and a second position where the support platform lies adjacent to the second distal ends and distant from the first distal ends.

35. The infant playpen apparatus according to claim 17, wherein the support platform includes a tubular frame, and at least one of the two coupling structures includes a housing affixed with the tubular frame, and a latch assembled with the housing, the latch having a disengaged state in which removal of the support platform from the rail structure is allowed, and an engaged state for restraining the support platform to remain on the rail structure while allowing displacement of the support platform along the rail structure.

* * * * *